US005476435A

United States Patent [19]

Nimmo

[11] Patent Number: 5,476,435

[45] Date of Patent: Dec. 19, 1995

[54] PORTABLE ARM EXERCISING APPARATUS

[76] Inventor: Joe M. Nimmo, 19968 Kinloch, Redford, Mich. 48240

[21] Appl. No.: 225,338

[22] Filed: Apr. 8, 1994

[51] Int. Cl.[6] ..... A63B 21/00

[52] U.S. Cl. ..... 482/124; 482/121; 482/126

[58] Field of Search ..... 482/105, 124, 482/133, 112, 126, 124, 121

[56] References Cited

U.S. PATENT DOCUMENTS

| | | | |
|---|---|---|---|
| 1,676,061 | 7/1928 | Strom | 482/129 |
| 2,488,534 | 11/1949 | Hagerman | 482/129 |
| 4,026,548 | 5/1977 | Birdwell | 482/129 |
| 4,384,715 | 5/1983 | Savio et al. | 482/129 |
| 4,441,707 | 4/1984 | Bosh | 482/124 |
| 4,647,037 | 3/1987 | Donohue | 482/82 |
| 5,071,119 | 12/1991 | Johnson | 482/112 |

FOREIGN PATENT DOCUMENTS

| | | | |
|---|---|---|---|
| 0451516 | 8/1936 | United Kingdom | 482/124 |

*Primary Examiner*—Richard J. Apley
*Assistant Examiner*—Jerome Donnelly

[57] ABSTRACT

A new and improved portable arm exercising apparatus includes a belt assembly adapted to fit around and adapted to be secured to a waist of a user. A first support assembly is connected to the belt assembly; a first swivel assembly is connected to the first support assembly; and a first counterforce unit is connected to the first swivel assembly. A second support assembly is connected to the belt assembly; a second swivel assembly is connected to the second support assembly; and a second counterforce unit is connected to the second swivel assembly. The first swivel assembly permits the first counterforce unit to swing in a substantially 180 angular degree are around the first support assembly in a plane contiguous to a first plane, and the first swivel assembly permits the first counterforce unit to rotate substantially 360 angular degrees around the first support assembly in a plane contiguous to a second plane. The first plane and the second plane are perpendicular to each other. The second swivel assembly permits the second counterforce unit to swing in a substantially 180 degree are around the second support assembly in a plane contiguous to a third plane, and the second swivel assembly permits the second counterforce unit to rotate substantially 360 angular degrees around the second support assembly in a plane contiguous to a fourth plane. An adjustment assembly is provided for adjusting tension in the spiral spring.

3 Claims, 3 Drawing Sheets

PORTABLE ARM EXERCISING APPARATUS

BACKGROUND OF THE INVENTION

1 . Field of the Invention

The present invention relates generally to exercising devices and, more particularly, to portable devices especially adapted for exercising a person's arms.

2. Description of the Prior Art

Of the many muscles in a human body, arm muscles often receive a great deal of attention during exercise. Hand-held dumbbells are portable devices that are commonly used for exercising arm muscles. However, a number of disadvantages are associated with hand-held dumbbells. A hand-held dumbbell generally has a fixed weight. However, for a person who exercises, it is often desirable to vary the weight that is employed during an exercise session. When a hand-held dumbbell is not being held in a person's hand, it must be set down somewhere. When a person is away from home, such as on a trip or vacation, the person may have a tendency to forget or overlook hand-held dumbbells that have been set down in a hotel or other rented room. In this respect, it would be desirable if a portable arm exercising device were provided that did not have to be set down in a hotel or rented room when the exercising device was not being held in a person's hand.

Hand-held dumbbells are useful in exercising because a person using the dumbbells must exert force on the dumbbells to overcome the force of gravity to lift the dumbbells. However, to increase exercising forces, the weights of the dumbbells must be increased. Other useful exercising devices are available which require a user to exert forces during exercise, but the forces exerted by the person are not used to overcome the force of gravity. Instead, spring-based exercising devices are employed which require a person to exert a force to compress or stretch a spring. With such spring-based exercising devices, large exercising forces may be exerted by a user without requiring weights to be increased. In this respect, it would be desirable if a portable arm exercising device were provided which is spring-based.

Throughout the years, a number of innovations have been developed relating to portable arm exercising devices, and the following U.S. patents are representative of some of those innovations: U.S. Pat. Nos. 4,961,573; 4,982,950; 5,096,190; 5,120,051; and 5,167,602. More specifically, U.S. Pat. No. 4,961,573 discloses an exercising harness that is adapted to be worn on a person's shoulders. Hand grips are attached to a system of elastic cords and pulleys, and the hand grips are positioned adjacent to the wearer's armpits. Pulleys and elastic cords have certain disadvantages. Elastic cords can fall off the pulleys, and the elastic cords can become twisted. In this respect, it would be desirable if a portable arm exercising device were provided which did not use pulleys and cords. The placement of the hand grips adjacent to the user's armpits may be useful for certain arm exercises, but such placement is not conducive to performing arm exercises known as arm curls. In this respect, it would be desirable if a portable arm exercising device were provided which were useful for performing arm curls.

U.S. Pat. No. 4,982,950 discloses an arm exercising device that employs a tubular structure that appears to be grasped by both hands simultaneously during use. Often, however, when a person exercises one's arms, it is desirable to exercise each arm independently of the other. In this respect, it would be desirable if a portable arm exercising device were provided which permits one arm to be exercised at a time without requiring the device to be held by two hands simultaneously.

U.S. Pat. No. 5,096,190 discloses an exercising device especially adapted for exercising a shoulder. A dumbbell is suspended by a chain from a strap whose end is grasped by the user. In using this device repetitively, considerable friction may be generated between the strap and the wearers shoulder. Such friction may generate uncomfortable amounts of heat or may prematurely wear out clothing that is in contact with the strap. In this respect, it would be desirable if a portable arm exercising device were provided which does not generate uncomfortable amounts of frictional heat next to a user's body and does not prematurely wear out clothing that is in contact with the device.

U.S. Pat. No. 5,120,051 discloses an arm exercising device that employs a pendulous weight suspended from a non-continuous collar worn around a user's neck. A disadvantage associated with this device is that the pendulous weight may swing uncontrollably under certain conditions. As a result, considerable stress and strain may be placed on a wearer's neck. In this respect, it would be desirable if a portable arm exercising device were provided which does not exert stress and strain on a user's neck.

U.S. Pat. No. 5,167,602 discloses a body exercising device that can be used for exercising a user's arms or legs. Although a portion of the device fits partially around a user's waist when the device is used for certain specific exercises. However, this device is not carried by the body of the user when the device is not being held in the user's hands. In this respect, it would be desirable if a portable arm exercising device were provided which were carried by the body of the user when the device is not being held in the user's hands.

Still other features would be desirable in a portable arm exercising apparatus. For example, it would be desirable for a portable arm exercising apparatus to be easily carried and taken with a user on a trip, on a vacation, or to the office. It would also be desirable for a portable arm exercising apparatus to be lightweight and compact so as to readily fit into a suitcase or sport bag.

Thus, while the foregoing body of prior art indicates it to be well known to use portable arm exercising devices, the prior art described above does not teach or suggest a portable arm exercising apparatus which has the following combination of desirable features: (1) can vary the exercising force that is exerted during an exercise session; (2) does not have to be set down in a hotel or rented room when the exercising device is not being held in a person's hand; (3) is spring-based; (4) does not use pulleys and cords; (5) is useful for performing arm curls; (6) permits one arm to be exercised at a time without requiring the device to be held by both hands simultaneously; (7) does not generate uncomfortable amounts of frictional heat next to a user's body and does not prematurely wear out clothing that is in contact with the device; (8) does not exert stress and strain on a user's neck; (9) can be carried by the body of the user when the device is not being held in the user's hands; (10) can be easily carried and taken with a user on a trip, on a vacation, or to the office; and (11) is lightweight and compact so as to readily fit into a suitcase or sport bag. The foregoing desired characteristics are provided by the unique portable arm exercising apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved portable arm exercising apparatus which includes a belt assembly adapted to fit around and adapted to be secured to a waist of a user. A first support assembly is connected to the belt assembly at a first location on the belt assembly. A first swivel assembly is connected to the first support assembly. A first counterforce unit is connected to the first swivel assembly. A second support assembly is connected to the belt assembly at a second location on the belt assembly. A second swivel assembly is connected to the second support assembly, and a second counterforce unit is connected to the second swivel assembly.

The first swivel assembly permits the first counterforce unit to swing in a substantially 180 angular degree are around the first support assembly in a plane contiguous to a first plane, and the first swivel assembly permits the first counterforce unit to rotate substantially 360 angular degrees around the first support assembly in a plane contiguous to a second plane. The first plane and the second plane are perpendicular to each other.

The second swivel assembly permits the second counterforce unit to swing in a substantially 180 degree arc around the second support assembly in a plane contiguous to a third plane, and the second swivel assembly permits the second counterforce unit to rotate substantially 360 angular degrees around the second support assembly in a plane contiguous to a fourth plane. The third plane is substantially perpendicular to the fourth plane.

The first swivel assembly includes a first ring is connected to the first support assembly, and a second ring is connected to the first counterforce unit. The first ring and the second ring are mutually inserted through each other. The second swivel assembly includes a first ring is connected to the second support assembly, and a second ring is connected to the second counterforce unit. The first ring and the second ring are mutually inserted through each other.

The first ring of the first swivel assembly is oriented vertically contiguous to a first plane. The second ring of the first swivel assembly is oriented vertically contiguous to a second plane. The first plane is perpendicular to the second plane when the first counterforce unit hangs immovably from the first support assembly. The first ring of the second swivel assembly is oriented vertically contiguous to a third plane. The second ring of the second swivel assembly is oriented vertically contiguous to a fourth plane. The third plane is perpendicular to the fourth plane when the second counterforce unit hangs immovably from the second support assembly.

The first counterforce unit and the second counterforce unit each includes a loop connected to a respective first ring. The loop and the respective first ring are mutually inserted in each other. A housing assembly supports the loop. A counterforce spring assembly is housed within the housing assembly, and a hand grip assembly is connected to the counterforce spring assembly. The counterforce spring assembly includes a spiral spring and a compression rod assembly for compressing the spiral spring when the hand grip assembly is pulled by a user.

The compression rod assembly includes a first end which includes a first spring retainer for contacting a first end of the spiral spring. A stem portion passes longitudinally through the spiral spring. A second end of the stem portion passes through an orifice in the housing assembly and is connected to the hand grip assembly. A second spring retainer, housed within the housing assembly, contacts a second end of the spiral spring.

An adjustment assembly is provided for adjusting tension in the spiral spring. The adjustment assembly includes a plurality of adjustment apertures arrayed longitudinally along the housing assembly.

A locking pin is capable of being placed in registration with a selected adjustment aperture. The locking pin is placed in registration with a selected adjustment aperture such that the locking pin is placed behind a first spring retainer in the compression rod assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable arm exercising apparatus which has all of the advantages of the prior art and none of the disadvantages.

It is another object of the present invention to provide a new and improved portable arm exercising apparatus which may be easily and efficiently manufactured and marketed.

It is a further object of the present invention to provide a new and improved portable arm exercising apparatus which is of durable and reliable construction.

An even further object of the present invention is to provide a new and improved portable arm exercising apparatus which is susceptible of a low cost of manufacture with regard to both materials and labor, and which accordingly is then susceptible of low prices of sale to the consuming public, thereby making such portable arm exercising apparatus available to the buying public.

Still yet a further object of the present invention is to provide a new and improved portable arm exercising apparatus which can vary the exercising force that is exerted during an exercise session.

Still another object of the present invention is to provide a new and improved portable arm exercising apparatus that does not have to be set down in a hotel or rented room when the exercising device is not being held in a person's hand.

Yet another object of the present invention is to provide a new and improved portable arm exercising apparatus which is spring-based.

Even another object of the present invention is to provide a new and improved portable arm exercising apparatus that does not use pulleys and cords.

Still a further object of the present invention is to provide a new and improved portable arm exercising apparatus which is useful for performing arm curls.

Yet another object of the present invention is to provide a new and improved portable arm exercising apparatus that permits one arm to be exercised at a time without requiring the device to be held by both hands simultaneously.

Still another object of the present invention is to provide a new and improved portable arm exercising apparatus which does not generate uncomfortable amounts of frictional heat next to a user's body and does not prematurely wear out clothing that is in contact with the device.

Yet another object of the present invention is to provide a new and improved portable arm exercising apparatus that does not exert stress and strain on a user's neck.

Still a further object of the present invention is to provide a new and improved portable arm exercising apparatus that can be carried by the body of the user when the device is not being held in the user's hands.

Yet another object of the present invention is to provide a new and improved portable arm exercising apparatus which can be easily carried and taken with a user on a trip, on a vacation, or to the office.

Still a further object of the present invention is to provide a new and improved portable arm exercising apparatus that is lightweight and compact so as to readily fit into a suitcase or sport bag.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved portable arm exercising apparatus embodying the principles and concepts of the present invention will be described.

Figure 1:
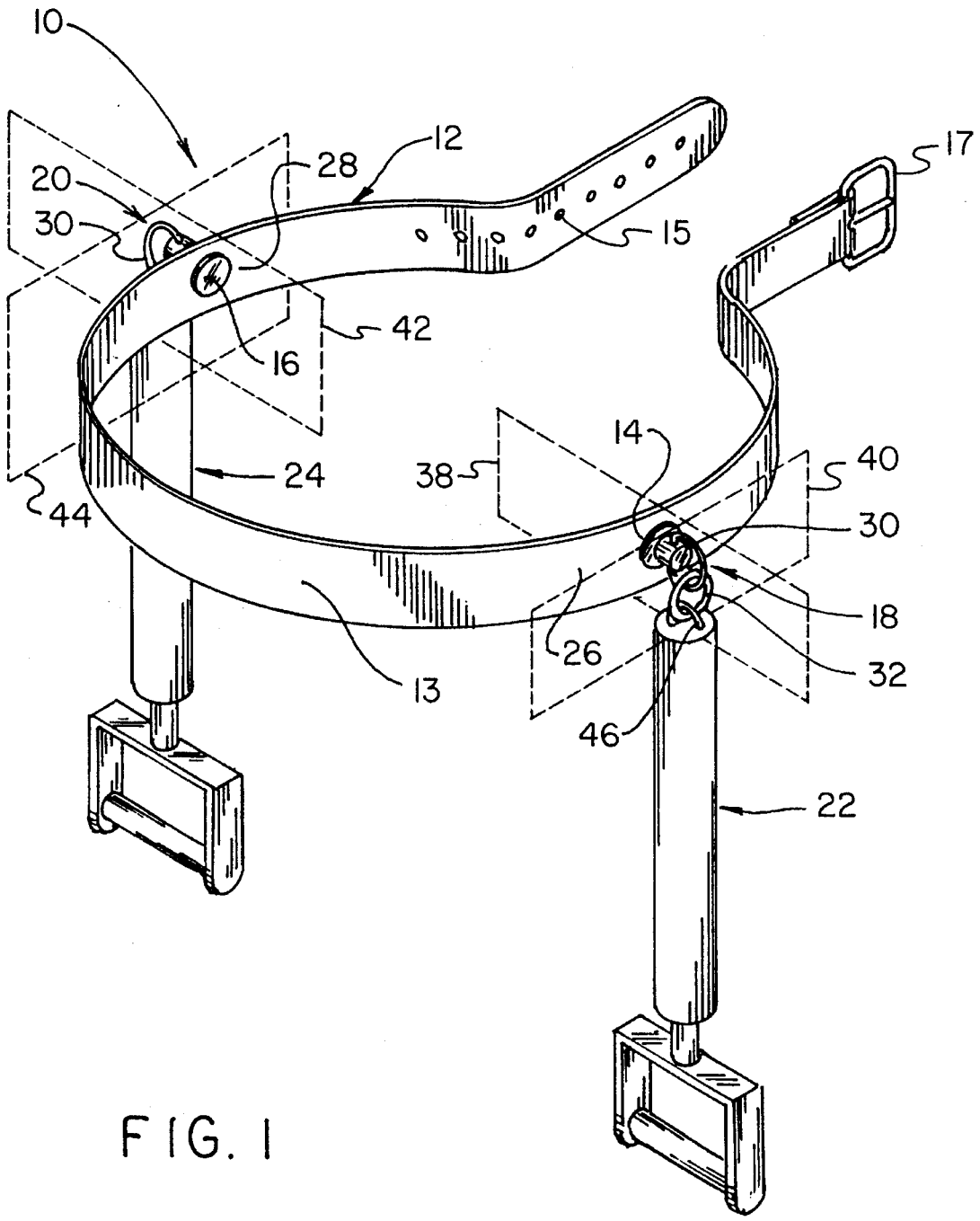
FIG. 1 is a perspective view showing a first preferred embodiment of the portable arm exercising apparatus of the invention.
Figure 2:
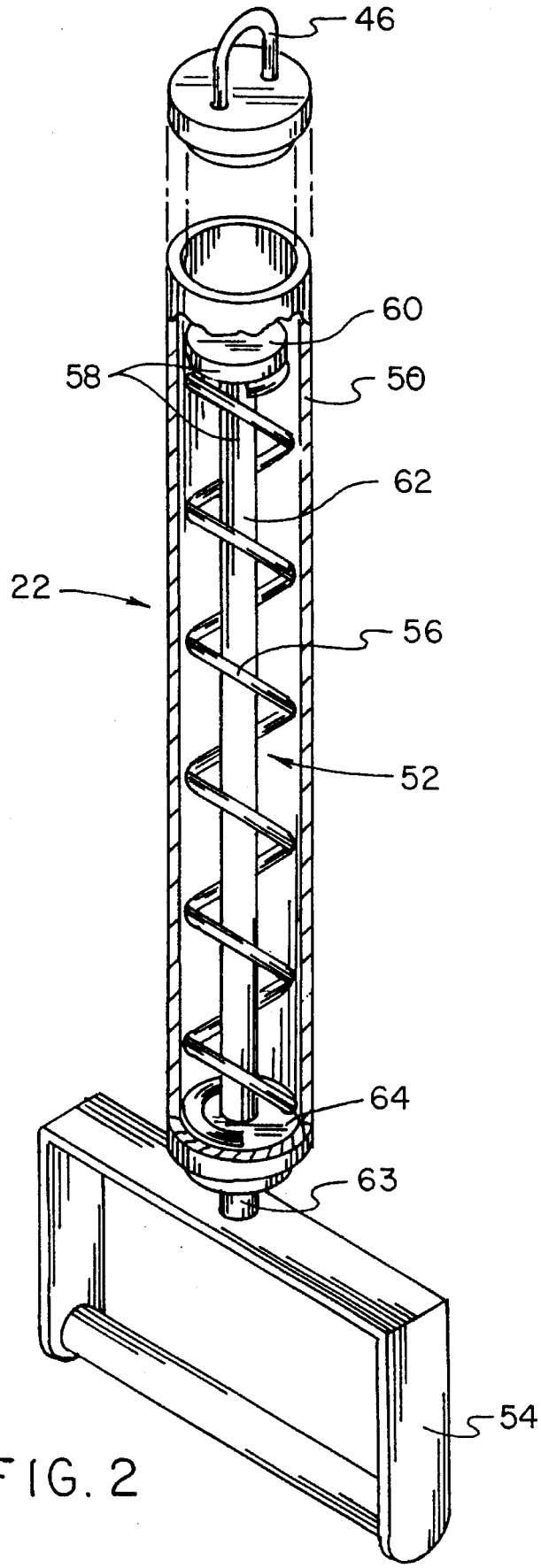
FIG. 2 is an enlarged, partially broken away, partially exploded perspective view of a counterforce assembly of the embodiment of the invention shown in FIG. 1.

Turning to FIGS. 1 and 2, there is shown a first exemplary embodiment of the portable arm exercising apparatus of the invention generally designated by reference numeral 10. In its preferred form, portable arm exercising apparatus 10 includes a belt assembly 12 adapted to fit around and adapted to be secured to a waist of a user. A first support assembly 14 is connected to the belt assembly 12 at a first location 26 on the belt assembly 12. A first swivel assembly 18 is connected to the first support assembly 14. A first counterforce unit 22 is connected to the first swivel assembly 18. A second support assembly 16 is connected to the belt assembly 12 at a second location 28 on the belt assembly 12. A second swivel assembly 20 is connected to the second support assembly 16, and a second counterforce unit 24 is connected to the second swivel assembly 20.

The belt assembly 12 includes a belt portion 13. A series of adjustment holes 15, and a buckle assembly 17. The belt assembly 12 is worn in a conventional way around a person's waist by buckling the buckle assembly 17 into a selected adjustment hole 15.

The first swivel assembly 18 permits the first counterforce unit 22 to swing in a substantially 180 angular degree arc around the first support assembly 14 in a plane contiguous to a first plane 38, and the first swivel assembly 18 permits the first counterforce unit 22 to rotate substantially 360 angular degrees around the first support assembly 14 in a plane contiguous to a second plane 40. The first plane 38 and the second plane 40 are perpendicular to each other.

The second swivel assembly 20 permits the second counterforce unit 24 to swing in a substantially 180 degree are around the second support assembly 16 in a plane contiguous to a third plane 42, and the second swivel assembly 20 permits the second counterforce unit 24 to rotate substantially 360 angular degrees around the second support assembly 16 in a plane contiguous to a fourth plane 44. The third plane 42 is substantially perpendicular to the fourth plane 44.

The first swivel assembly 18 includes a first ring 30 is connected to the first support assembly 14, and a second ring 32 is connected to the first counterforce unit 22. The first ring 30 and the second ring 32 are mutually inserted through each other. The second swivel assembly 20 includes a first ring 30 is connected to the second support assembly 16, and a second ring 32 is connected to the second counterforce unit 24. The first ring 30 and the second ring 32 are mutually inserted through each other.

The first ring 30 of the first swivel assembly 18 is oriented vertically contiguous to a first plane 38. The second ring 32 of the first swivel assembly 18 is oriented vertically contiguous to a second plane 40. The first plane 38 is perpendicular to the second plane 40 when the first counterforce unit 22 hangs immovably from the first support assembly 14. The first ring 30 of the second swivel assembly 20 is oriented vertically contiguous to a third plane 42. The second ring 32 of the second swivel assembly 20 is oriented vertically contiguous to a fourth plane 44. The third plane 42 is perpendicular to the fourth plane 44 when the second counterforce unit 24 hangs immovably from the second support assembly 16.

The mutual insertion of the first ring 30 and the second ring 32 in each other in the first swivel assembly 18 permits the first counterforce unit 22 to rotate substantially 360 angular degrees around the first ring 30 in a plane contiguous to the second plane 40. Similarly, the mutual insertion of the first ring 30 and the second ring 32 in each other permits the first counterforce unit 22 to swing in a substantially 180 angular degree arc around the first ring 30 in a plane contiguous to the first plane 38.

In like manner, the mutual insertion of the first ring 30 and the second ring 32 in each other in the second swivel assembly 20 permits the second counterforce unit 24 to rotate substantially 360 angular degrees around the first ring 30 in a plane contiguous to the fourth plane 44. Similarly, the mutual insertion of the first ring 30 and the second ring 32 in each other permits the second counterforce unit 24 to swing in a substantially 180 degree arc around the first ring 30 in a plane contiguous to the third plane 42. When the user lets go of the first counterforce unit 22 and the second counterforce unit 24, the belt assembly 12 remains attached to the waist of the user, and the first counterforce unit 22 and the second counterforce unit 24 are free to hang from the first swivel assembly 18 and the second swivel assembly 20, respectively. The first counterforce unit 22 and the second counterforce unit 24 can be operated independently of each other.

The first counterforce unit 22 and the second counterforce unit 24 each includes a loop 46 connected to a respective first ring 30. The loop 46 and the respective first ring 30 are mutually inserted in each other. A housing assembly 50 supports the loop 46. A counterforce spring assembly 52 is housed within the housing assembly 50, and a hand grip assembly 54 is connected to the counterforce spring assembly 52. The counterforce spring assembly 52 includes a spiral spring 56 and a compression rod assembly 58 for compressing the spiral spring 56 when the hand grip assembly 54 is pulled by a user.

The compression rod assembly 58 includes a first end which includes a first spring retainer 60 for contacting a first end of the spiral spring 56. A stem portion 62 passes longitudinally through the spiral spring 56. A second end 63 of the stem portion 62 passes through an orifice in the housing assembly 50 and is connected to the hand grip assembly 54. A second spring retainer 64, housed within the housing assembly 50, contacts a second end of the spiral spring 56.

When the first counterforce unit 22 and the second counterforce unit 24 are used, a person grasps a respective hand grip assembly 54. The person pulls each hand grip assembly 54 in a direction away from the belt assembly 12. As a result, the stem portion 62 of the compression rod assembly 58 pulls on the first spring retainer 60 causing the spiral spring 56 to be compressed between the first spring retainer 60 and the second spring retainer 64 as the hand grip assembly 54 pulls more and more of the stem portion 62 out of the housing assembly 50. More and more counterforce is created by the spiral spring 56 as the spiral spring 56 becomes more and more compressed as the person pulls on the hand grip assembly 54. When the person relaxes the pull on the hand grip assembly 54, then the spiral spring 56 becomes relaxed, and the spiral spring 56 returns to its initial position, causing more and more of the stem portion 62 of the compression rod assembly 58 back into the housing.

The portable arm exercising apparatus 10 is especially suitable for a user to perform arm curls against the counterforce established by the respective spiral springs 56 within the respective housing assemblies 50 of the respective first counterforce unit 22 and second counterforce unit 24.

Figure 3:
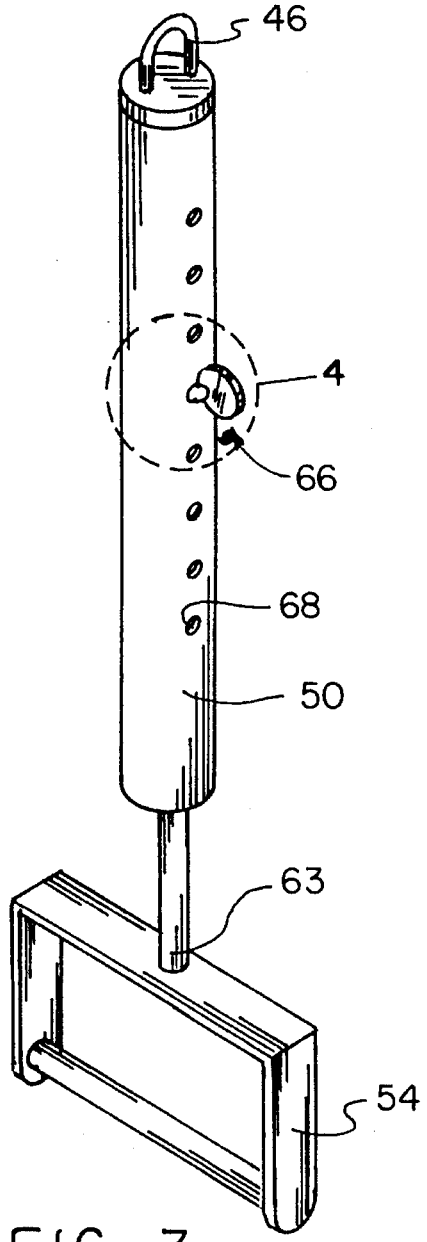
FIG. 3 is a perspective view of a second embodiment of a counterforce assembly of the portable arm exercising apparatus of the invention.
Figure 4:
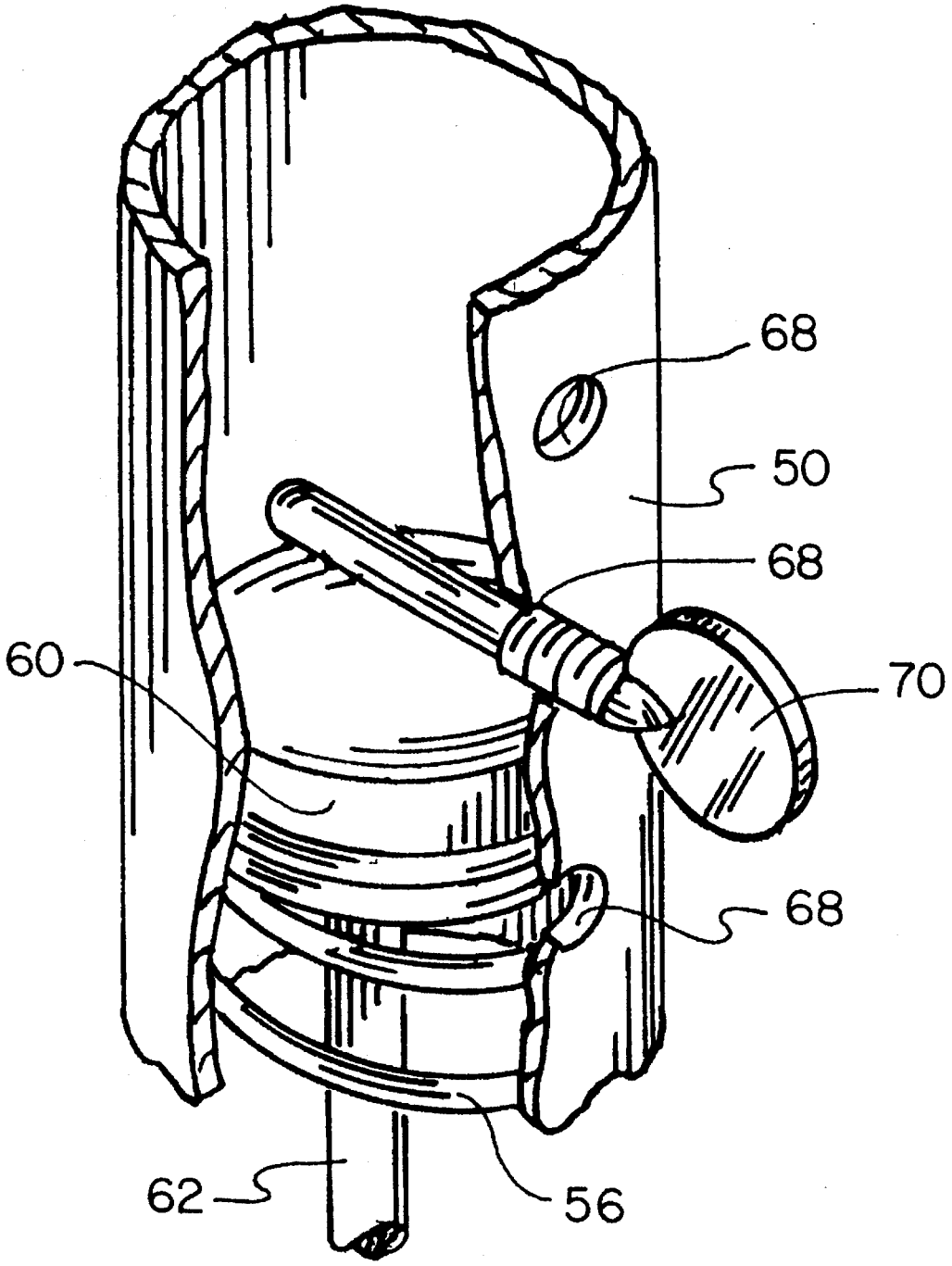
FIG. 4 is an enlarged, partially broken away perspective view of a portion of the second embodiment of the counterforce assembly of the invention shown in FIG. 3 shown in the circled region 4 of FIG. 3.

Turning to FIGS. 3 and 4, a second embodiment of the invention is shown. Reference numerals are shown that correspond to like reference numerals that designate like elements shown in the other figures. An adjustment assembly 66 is provided for adjusting tension in the spiral spring 56. The adjustment assembly 66 includes a plurality of adjustment apertures 68 arrayed longitudinally along the housing assembly 50.

A locking pin 70 is capable of being placed in registration with a selected adjustment aperture 68. The locking pin 70 is placed in registration with a selected adjustment aperture 68 such that the locking pin 70 is placed behind a first spring retainer 60 in the compression rod assembly 58.

In using the adjustment assembly 66, the hand grip assembly 54 is pulled out by a user such that the first spring retainer 60 of the compression rod assembly 58 moves longitudinally down the interior of the housing assembly 50. When the first spring retainer 60 reaches a selected position, the locking pin 70 is placed through a selected adjustment aperture 68. With the locking pin 70 in the selected adjustment aperture 68, the spiral spring 56 is prevented from relaxing to a position past the locking pin 70. The locking pin 70 serves as an adjustment stop for the spiral spring 56.

The components of the portable arm exercising apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved portable arm exercising apparatus that is low in cost, relatively simple in design and operation, and which may advantageously be used to vary the exercising force that is exerted during an exercise session. With the invention, a portable arm exercising apparatus is provided which does not have to be set down in a hotel or rented room when the exercising device is not being held in a person's hand. With the invention, a portable arm exercising apparatus is provided which is spring-based. With the invention, a portable arm exercising apparatus is provided which does not use pulleys and cords. With the invention, a portable arm exercising apparatus is provided which is useful for performing arm curls. With the invention, a portable arm exercising apparatus is provided which permits one arm to be exercised at a time without requiring the device to be held by both hands simultaneously.

With the invention, a portable arm exercising apparatus is provided which does not generate uncomfortable amounts of frictional heat next to a user's body and does not prematurely wear out clothing that is in contact with the device. With the invention, a portable arm exercising apparatus is provided which does not exert stress and strain on a user's neck. With the invention, a portable arm exercising apparatus is provided which can be carried by the body of the user when the device is not being held in the user's hands. With the invention, a portable arm exercising apparatus is provided which can be easily carried and taken with a user on a trip, on a vacation, or to the office. With the invention, a portable arm exercising apparatus is provided which is lightweight and compact so as to readily fit into a suitcase or sport bag.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

What is claimed as being new and desired to be protected by LETTERS PATENT of the United States is as follows:

1. A new and improved portable arm exercising apparatus, comprising:

a belt assembly adapted to fit around and adapted to be secured to a waist of a user, a first support assembly connected to said belt assembly at a first location on said belt assembly, a first swivel assembly connected to said first support assembly, a first counterforce unit connected to said first swivel assembly, a second support assembly connected to said belt assembly at a second location on said belt assembly, a second swivel assembly connected to said second support assembly, and a second counterforce unit connected to said second swivel assembly, which is distinct and separate from said first spring retainer, wherein said first swivel assembly permits said first counterforce unit to swing in a substantially 180 angular degree arc around said first support assembly in a plane contiguous to a first plane, and said first swivel assembly permits said first counterforce unit to rotate substantially 360 angular degrees around said first support assembly in a plane contiguous to a second plane, wherein said first plane and said second plane are perpendicular to each other, wherein said second swivel assembly permits said second counterforce unit to swing in a substantially 180 degree arc around said second support assembly in a plane contiguous to a third plane, and said second swivel assembly permits said second counterforce unit to rotate substantially 360 angular degrees around said second support assembly in a plane contiguous to a fourth plane, wherein said third plane is substantially perpendicular to said fourth plane, wherein said first swivel assembly includes a first ring connected to said first support assembly, and a second ring connected to said first counterforce unit, wherein said first ring and said second ring are mutually inserted through each other, wherein said first ring of said first swivel assembly is oriented vertically contiguous to a first plane, wherein said second ring of said first swivel assembly is oriented vertically contiguous to a second plane, wherein said first plane is perpendicular to said second plane when said first counterforce unit hangs immovably from said first support assembly, wherein said second swivel assembly includes a first ring connected to said second support assembly, and a second ring connected to said second counterforce unit, wherein said first ring and said second ring are mutually inserted through each other, wherein said first ring of said second swivel assembly is oriented vertically contiguous to a third plane, wherein said second ring of said second swivel assembly is oriented vertically contiguous to a fourth plane, wherein said third plane is perpendicular to said fourth plane when said second counterforce unit hangs immovably from said second support assembly, wherein said first counterforce unit and said second counterforce unit each includes a loop connected to a respective first ring wherein said loop and said respective first ring are mutually inserted in each other, a housing assembly supporting said loop, a counterforce spring assembly housed within said housing assembly, and a hand grip assembly connected to said counterforce spring assembly, wherein said counterforce spring assembly includes a spiral spring, and a compression rod assembly for compressing said spiral spring when said hand grip assembly is pulled by a user, and wherein said compression rod assembly includes a first end which includes a first spring retainer for contacting a first end of said spiral spring, a stem portion which passes longitudinally through said spiral spring, a second end which passes through an orifice in said housing assembly and is connected to said hand grip assembly, and a second spring retainer, housed within said housing assembly, for contacting a second end of said spiral spring, and further including, a tension adjustment assembly for adjusting tension in said spiral spring.

2. The apparatus described in claim wherein said tension adjustment assembly includes:

a plurality of adjustment apertures arrayed longitudinally along said housing assembly, and a locking pin capable of being placed in registration with a selected adjustment aperture for adjusting tension in said spiral spring.

3. A new and improved portable arm exercising apparatus, comprising:

a belt assembly adapted to fit around and adapted to be secured to a waist of a user, a first support assembly connected to said belt assembly at a first location on said belt assembly, a first swivel assembly connected to said first support assembly, a first counterforce unit connected to said first swivel assembly, a second support assembly connected to said belt assembly at a second location on said belt assembly, a second swivel assembly connected to said second support assembly, and a second counterforce unit connected to said second swivel assembly, wherein said first swivel assembly permits said first counterforce unit to swing in a substantially 180 angular degree arc around said first support assembly in a plane contiguous to a first plane, and said first swivel assembly permits said first counterforce unit to rotate substantially 360 angular degrees around said first support assembly in a plane contiguous to a second plane, wherein said first plane and said second plane are perpendicular to each other, wherein said second swivel assembly permits said second counterforce unit to swing in a substantially 180 degree arc around said second support assembly in a plane contiguous to a third plane, and said second swivel assembly permits said second counterforce unit to rotate substantially 360 angular degrees around said second support assembly in a plane contiguous to a fourth plane, wherein said third plane is substantially perpendicular to said fourth plane, wherein said first swivel assembly includes a first ring connected to said first support assembly, and a second ring connected to said first counterforce unit, wherein said first ring and said second ring are mutually inserted through each other, wherein said first ring of said first swivel assembly is oriented vertically contiguous to a first plane, wherein said second ring of said first swivel assembly is oriented vertically contiguous to a second plane, wherein said first plane is perpendicular to said second plane when said first counterforce unit hangs immovably from said first support assembly, wherein said second swivel assembly includes a first ring connected to said second support assembly, and a second ring connected to said second counterforce unit, wherein said first ring and said second ring are mutually inserted through each other, wherein said first ring of said second swivel assembly is oriented vertically contiguous to a third plane, wherein said second ring of said second swivel assembly is oriented vertically contiguous to a fourth plane, wherein said third plane is perpendicular to said fourth plane when said second counterforce unit hangs immovably from said second support assembly, wherein said first counterforce unit and said second counterforce unit each includes a loop connected to a respective first ring wherein said loop and said respective first ring are mutually inserted in each other, a housing assembly supporting said loop, a counterforce spring assembly housed within said housing assembly, and a hand grip assembly connected to said counterforce spring assembly, wherein said counterforce spring assembly includes a spiral spring, and a compression rod assembly for compressing said spiral spring when said hand grip assembly is pulled by a user, and wherein said compression rod assembly includes a first end which includes a first spring retainer for contacting a first end of said spiral spring, a stem portion which passes longitudinally through said spiral spring, a second end which passes through an orifice in said housing assembly and is connected to said hand grip assembly, and a second spring retainer, housed within said housing assembly, for contacting a second end of said spiral spring, and further including, a tension adjustment assembly for adjusting tension in said spiral spring, wherein said tension adjustment assembly includes a plurality of adjustment apertures arrayed longitudinally along said housing assembly, and a locking pin capable of being placed in registration with a selected adjustment aperture for adjusting tension in said spiral spring, wherein said locking pin is placed in registration with a selected adjustment aperture such that said locking pin is placed behind a first spring retainer in said compression rod assembly for adjusting tension in said spiral spring.

* * * * *